US012687342B2

(12) United States Patent
Maema et al.

(10) Patent No.: US 12,687,342 B2
(45) Date of Patent: Jul. 21, 2026

(54) HEAT EXCHANGER

(71) Applicant: FUJITSU GENERAL LIMITED, Kanagawa (JP)

(72) Inventors: Yoshinari Maema, Kanagawa (JP); Daiki Shimano, Kanagawa (JP); Shohei Nakata, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 438 days.

(21) Appl. No.: 18/019,200

(22) PCT Filed: Jul. 30, 2021

(86) PCT No.: PCT/JP2021/028276
§ 371 (c)(1),
(2) Date: Feb. 1, 2023

(87) PCT Pub. No.: WO2022/030376
PCT Pub. Date: Feb. 10, 2022

(65) Prior Publication Data

US 2023/0288145 A1 Sep. 14, 2023

(30) Foreign Application Priority Data

Aug. 3, 2020 (JP) ..... 2020-131928

(51) Int. Cl.
*F28D 7/16* (2006.01)
*F28F 9/02* (2006.01)

(52) U.S. Cl.
CPC ..... *F28D 7/16* (2013.01); *F28F 9/02* (2013.01); *F28F 9/0202* (2013.01); *F28F 9/0204* (2013.01); *F28F 9/0214* (2013.01)

(58) Field of Classification Search
CPC ... F28D 7/16; F28F 9/02; F28F 9/0202; F28F 9/0204; F28F 9/0214
(Continued)

(56) References Cited

U.S. PATENT DOCUMENTS

2008/0023183 A1* 1/2008 Beamer ..... F28F 9/0273 165/174
2011/0315364 A1* 12/2011 Matter, III ..... B23P 15/26 165/177
(Continued)

FOREIGN PATENT DOCUMENTS

CN 110476035 A 11/2019
EP 3425320 A1 1/2019
(Continued)

OTHER PUBLICATIONS

Jul. 24, 2024, European Search Report issued for related EP Application No. 21854298.3.
(Continued)

*Primary Examiner* — Joel M Attey
(74) *Attorney, Agent, or Firm* — Paratus Law Group, PLLC

(57) ABSTRACT

A heat exchanger includes a plurality of flat heat transfer tubes, and a header in which an insertion space is formed, wherein a plurality of first flow channels and a plurality of second flow channels are formed in each of the flat heat transfer tubes, the header includes a wall that divides the insertion space into a first space and a second space, a pipe penetration wall portion through which the flat heat transfer tubes pass such that the first flow channels are connected to the first space and the second flow channels are connected to the second space, and an inlet portion that supplies a refrigerant to the first space such that the refrigerant flows toward an inner wall surface of the pipe penetration wall portion that is in contact with the first space, and the wall is away from the pipe penetration wall portion.

12 Claims, 8 Drawing Sheets

(58) Field of Classification Search
USPC ..... 165/175
See application file for complete search history.

(56) References Cited

U.S. PATENT DOCUMENTS

| | | | | |
|---|---|---|---|---|
| 2016/0370126 | A1* | 12/2016 | Miller | F28F 9/165 |
| 2020/0025428 | A1 | 1/2020 | Inoue et al. | |
| 2021/0018190 | A1 | 1/2021 | Hirokawa et al. | |
| 2022/0196335 | A1 | 6/2022 | Watanabe et al. | |
| 2022/0316804 | A1* | 10/2022 | Onaka | F25B 39/00 |

FOREIGN PATENT DOCUMENTS

| | | | |
|---|---|---|---|
| EP | 3473963 | A1 | 4/2019 |
| EP | 3922941 | A1 | 12/2021 |
| JP | 2005-308261 | A | 11/2005 |
| JP | 2006-266521 | A | 10/2006 |
| JP | 2014-037899 | A | 2/2014 |
| JP | 2016-070622 | A | 5/2016 |
| JP | 2016-070624 | A | 5/2016 |
| JP | 2017-044428 | A | 3/2017 |
| JP | 2018-100800 | A | 6/2018 |
| JP | 2019-056544 | A | 4/2019 |
| JP | 2019-074287 | A | 5/2019 |
| JP | 2019-178804 | A | 10/2019 |
| JP | 6664558 | B1 | 3/2020 |
| JP | 6693588 | B1 | 5/2020 |
| JP | 2020-165644 | A | 10/2020 |

OTHER PUBLICATIONS

Jan. 19, 2026, Chinese Office Action issued for related CN Application No. 202180058150.6.

* cited by examiner

HEAT EXCHANGER

CROSS REFERENCE TO PRIOR APPLICATION

This application is a National Stage Patent Application of PCT International Patent Application No. PCT/JP2021/028276 (filed on Jul. 30, 2021) under 35 U.S.C. § 371, which claims priority to Japanese Patent Application No. 2020-131928 (filed on Aug. 3, 2020), which are all hereby incorporated by reference in their entirety.

FIELD

The present invention relates to a heat exchanger.

BACKGROUND

There is a known heat exchanger that has a structure in which both ends of flat heat transfer tubes having a plurality of flow channels are inserted into and connected to each of two headers and a flow of a refrigerant is branched off and flows from one of the headers to the flat heat transfer tubes and that performs heat exchange between the refrigerant and air (Patent Literatures 1 and 2).

In an air conditioner, a refrigerant that enters a gas phase state from a gas-liquid two-phase state on the way passing through the heat exchanger that is used as an evaporator flows out in an overheated state on an outlet side. The refrigerant that is in the overheated state has a temperature difference ΔT with air that is smaller than that at the time of the gas-liquid two-phase state, so that a heat exchange amount @ (=K*AT*A, where K denotes a coefficient of overall heat transfer and A denotes a heat transfer area) with air is consequently decreased. Furthermore, in the case where the degree of dryness of a refrigerant at an outlet of the heat exchanger falls below 1.0, an average value of the degree of dryness of the refrigerant passing through the heat exchanger is decreased, as compared to a case in which the degree of dryness of the refrigerant that has passed through the heat exchanger is 1.0. If the average value of the degree of dryness of the refrigerant passing through the heat exchanger is decreased, a flow velocity of the refrigerant is decreased, so that a heat transfer coefficient on the refrigerant side is decreased. If the heat transfer coefficient on the refrigerant side is low, the coefficient of overall heat transfer K between the refrigerant and air is decreased, and thus, the heat exchange amount between the refrigerant and the air is decreased. Accordingly, it is ideal that, when the heat exchanger is used as an evaporator, a refrigerant circulation volume is adjusted such that the degree of dryness of the refrigerant at an outlet of the heat exchanger is just 1.0.

CITATION LIST

Patent Literature

Patent Literature 1: Japanese Laid-open Patent Publication No. 2006-266521

Patent Literature 2: Japanese Laid-open Patent Publication No. 2018-100800

SUMMARY

Technical Problem

In contrast, when heat exchange is performed between external air and a refrigerant by using the above described heat exchanger, a temperature difference between the air and the flow channel that is located on the upwind side of the flat heat transfer tube is large, and thus, a heat exchange amount is larger than that on the downwind side. Accordingly, when a heat exchanger is used as, for example, an evaporator, only the refrigerant flowing through the flow channel located on the upwind side of the flat heat transfer tube enters a gas phase state, and this gas phase refrigerant may become an overheated state. In contrast, in order to prevent the refrigerant flowing through the flow channel that is located on the upwind side from being evaporated and becoming an overheated state, it is conceivable to allow the refrigerant in which the degree of dryness is low to flow into the flat heat transfer tube. However, the flow channel located on the downwind side of the flat heat transfer tube has a heat exchange amount smaller than that of the flow channel that is located on the upwind side of the flat heat transfer tube. As a result, heat exchange between the air and the refrigerant flowing through the flow channel located on the downwind side of the flat heat transfer tube is insufficient, and thus, the degree of dryness of the refrigerant that has passed through the subject flow channel is lower than 1.0. In this case, as compared to an ideal case in which the refrigerant circulation volume is adjusted such that the degree of dryness of the refrigerant that has passed through the heat exchanger is just 1.0, there is a problem in that the heat exchange amount between the refrigerant and the air is decreased as a result of a decrease in the coefficient of overall heat transfer K between the refrigerant and the air.

Accordingly, the disclosed technology has been conceived in light of the circumstances described above and an object thereof is to provide a heat exchanger that improves a heat exchange amount between air and a refrigerant.

Solution to Problem

According to an aspect of an embodiment, a heat exchanger includes a plurality of flat heat transfer tubes in each of which a plurality of first flow channels and a plurality of second flow channels are formed in an interior portion of each of the plurality of flat heat transfer tubes, and a header in which an insertion space is formed, wherein the header includes a pipe penetration wall portion through which the plurality of flat heat transfer tubes pass such that the plurality of first flow channels are connected to a first space included in the insertion space and the plurality of second flow channels are connected to a second space included in the insertion space, a wall that divides the insertion space into the first space and the second space, and an inlet portion that supplies a refrigerant to the first space such that the refrigerant flows toward an inner wall surface of the pipe penetration wall portion that is in contact with the first space, and the wall is away from the pipe penetration wall portion such that a communication path through which the refrigerant flows from the first space to the second space is formed between the wall and the pipe penetration wall portion.

Advantageous Effects of Invention

The disclosed heat exchanger is able to improve the heat exchange amount between the air and the refrigerant.

DESCRIPTION OF EMBODIMENTS

Figure 1:
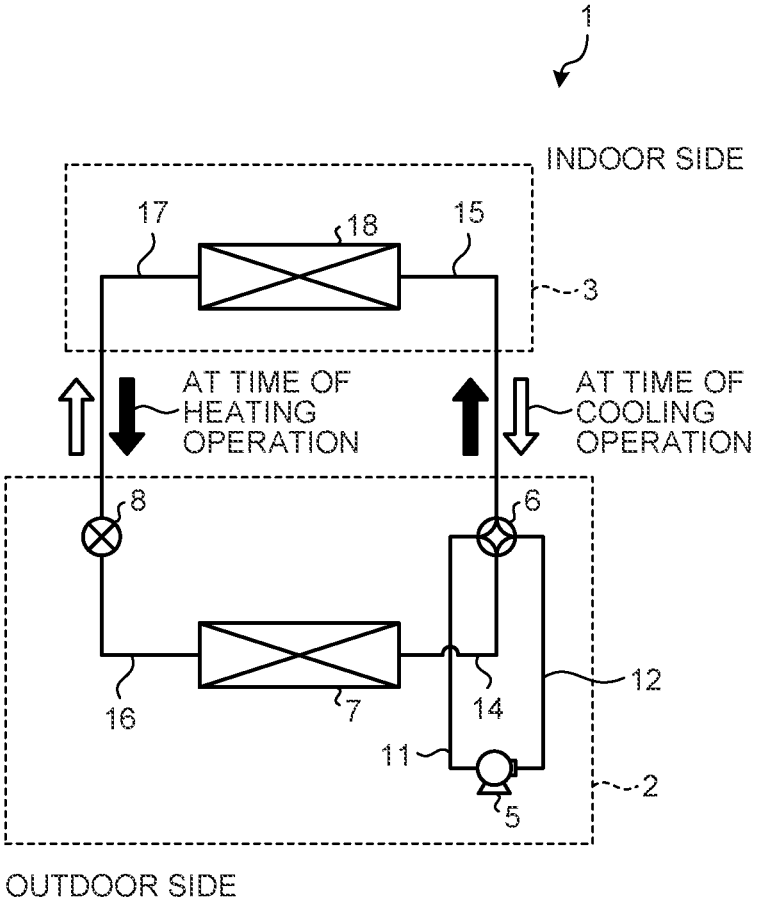
FIG. 1 is a block diagram illustrating an air conditioning apparatus in which a heat exchanger according to a first embodiment is installed.

In the following, a heat exchanger according to embodiments disclosed in the present invention will be explained in detail with reference to accompanying drawings. Furthermore, the disclosed technology is not limited to the description below. In addition, in the description below, components that are the same as those in the embodiments are assigned the same reference numerals, and overlapping description will be omitted.

First Embodiment

Air Conditioning Apparatus

A heat exchanger 7 according to a first embodiment is provided in an air conditioning apparatus 1, as illustrated in FIG. 1. FIG. 1 is a block diagram illustrating the air conditioning apparatus 1 in which the heat exchanger 7 according to the first embodiment is provided. The air conditioning apparatus 1 includes an outdoor unit 2 and an indoor unit 3. The outdoor unit 2 is installed outdoors. The indoor unit 3 is installed in a room that is cooled and heated by the air conditioning apparatus 1. The outdoor unit 2 includes a compressor 5, a four-way valve 6, the heat exchanger 7, and an expansion valve 8. The compressor 5 is connected to the four-way valve 6 via an intake pipe 11, and is connected to the four-way valve 6 via a discharge pipe 12. The compressor 5 compresses a low pressure gas phase refrigerant that is supplied from the intake pipe 11, and discharges, to the discharge pipe 12, the high pressure gas phase refrigerant that is generated as a result of the low pressure gas phase refrigerant being compressed.

The four-way valve 6 is connected to the heat exchanger 7 via a refrigerant pipe 14 and is connected to the indoor unit 3 via a refrigerant pipe 15. The four-way valve 6 is switched to a direction in which the air conditioning apparatus 1 performs a cooling operation (cooling mode) or switched to a direction in which the air conditioning apparatus 1 performs a heating operation (heating mode). The four-way valve 6 performs control such that, in the case where the operation is switched to the cooling mode, the discharge pipe 12 is connected to the refrigerant pipe 14 and the refrigerant pipe 15 is connected to the intake pipe 11. The four-way valve 6 performs control such that, in the case where the operation is switched to the heating mode, the discharge pipe 12 is connected to the refrigerant pipe 15 and the refrigerant pipe 14 is connected to the intake pipe 11. The heat exchanger 7 is connected to the expansion valve 8 via a refrigerant pipe 16. The expansion valve 8 is connected to the indoor unit 3 via a refrigerant pipe 17. The indoor unit 3 includes a heat exchanger 18. The heat exchanger 18 is connected to the four-way valve 6 included in the outdoor unit 2 via the refrigerant pipe 15, and is connected to the expansion valve 8 included in the outdoor unit 2 via the refrigerant pipe 17.

Heat Exchanger 7

Figure 2:
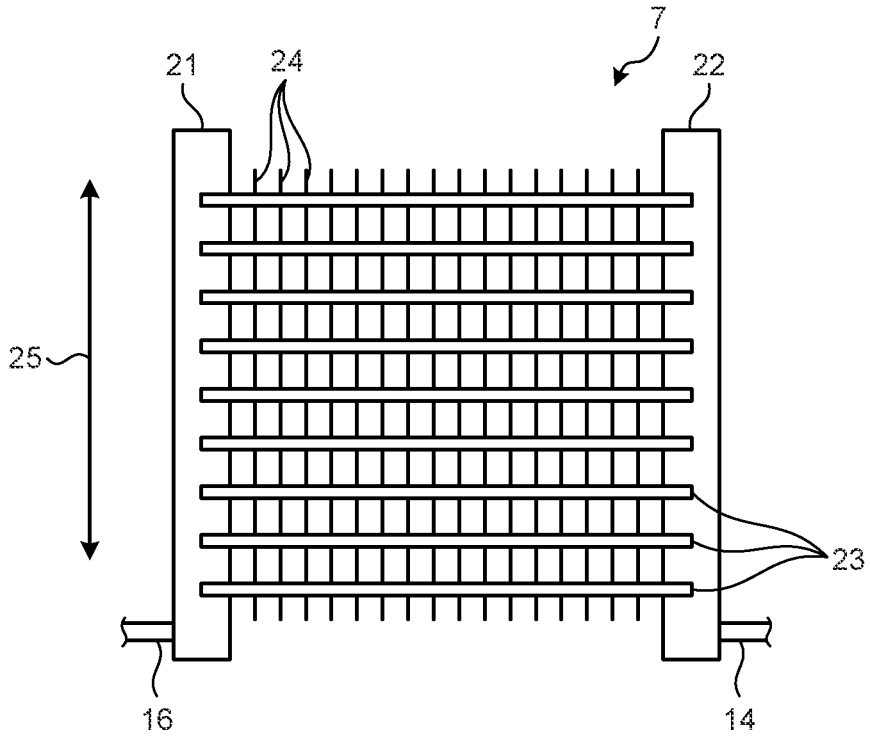
FIG. 2 is a front view illustrating the heat exchanger according to the first embodiment.

FIG. 2 is a front view illustrating the heat exchanger 7 according to the first embodiment. The heat exchanger 7 includes a header 21, a header 22, a plurality of flat heat transfer tubes 23, and a plurality of fins 24. The header 21 is formed in a tubular shape, and is disposed so as to be along a straight line that is parallel to an up-down direction 25. The up-down direction 25 is substantially parallel to the vertical direction at the time when the heat exchanger 7 is installed. The refrigerant pipe 16 is bonded to the header 21, an interior portion of the header 21 is connected to the expansion valve 8 via the refrigerant pipe 16. The header 22 is formed in a tubular shape, is disposed so as to be along a straight line that is parallel to the up-down direction 25, and is also disposed such that the position of an end portion of the header 21 in the up-down direction 25 is equal to the position of an end portion of the header 22 in the up-down direction 25. The refrigerant pipe 14 is bonded to the header 22, and an interior portion of the header 22 is connected to the four-way valve 6 via the refrigerant pipe 14.

Each of the plurality of flat heat transfer tubes 23 is formed in a linear strip shape. The plurality of flat heat transfer tubes 23 are disposed between the header 21 and the header 22 with a predetermined gap in the up-down direction 25. A plurality of straight lines that are along the plurality of respective flat heat transfer tubes 23 are parallel with each other, are perpendicular to the up-down direction 25, are perpendicular to the straight line that is along the header 21, and are perpendicular to the straight line that is along the header 22. One end of each of the plurality of flat heat transfer tubes 23 is bonded to the header 21 and is fixed to the header 21. The other end of each of the plurality of flat heat transfer tubes 23 is bonded to the header 22 and is fixed to the header 22.

Each of the plurality of fins 24 is formed in a flat plate shape. The plurality of fins 24 are disposed so as to be along a plurality of planes that are perpendicular to the plurality of straight lines that are along the plurality of flat heat transfer tubes 23, respectively. The plurality of fins 24 are bonded to the plurality of flat heat transfer tubes 23, respectively, such that the plurality of fins 24 are thermally connected to the plurality of flat heat transfer tubes 23, and are fixed to the plurality of flat heat transfer tubes 23, respectively.

Figure 3:
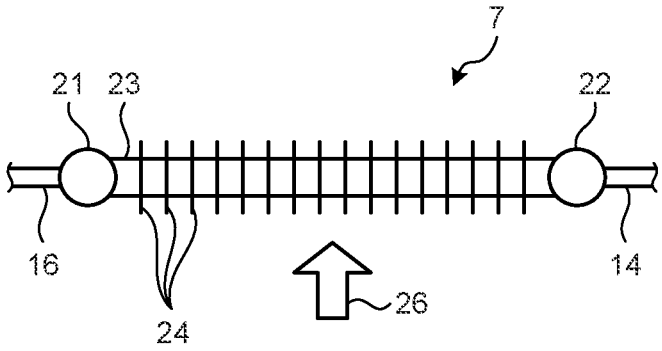
FIG. 3 is a plan view illustrating the heat exchanger according to the first embodiment.

The outdoor unit 2 includes a fan that is not illustrated. The fan is disposed in the interior portion of the outdoor unit 2, and sends external air such that the external air flow through the interior portion of the outdoor unit 2. FIG. 3 is a plan view illustrating the heat exchanger 7 according to the first embodiment. A flow direction 26 in which the external air flows in the interior portion of the outdoor unit 2 caused by the fan is perpendicular to the up-down direction 25, i.e., is substantially parallel to the horizontal plane when the heat exchanger 7 is installed. The heat exchanger 7 is disposed in the interior portion of the outdoor unit 2 such that a plurality of planes that are along the plurality of respective fins 24 are parallel to the flow direction 26, and is also disposed such that the plurality of straight lines that are along the plurality of respective flat heat transfer tubes 23 are perpendicular to the flow direction 26.

Plurality of Flat Heat Transfer Tubes 23

Figure 4:
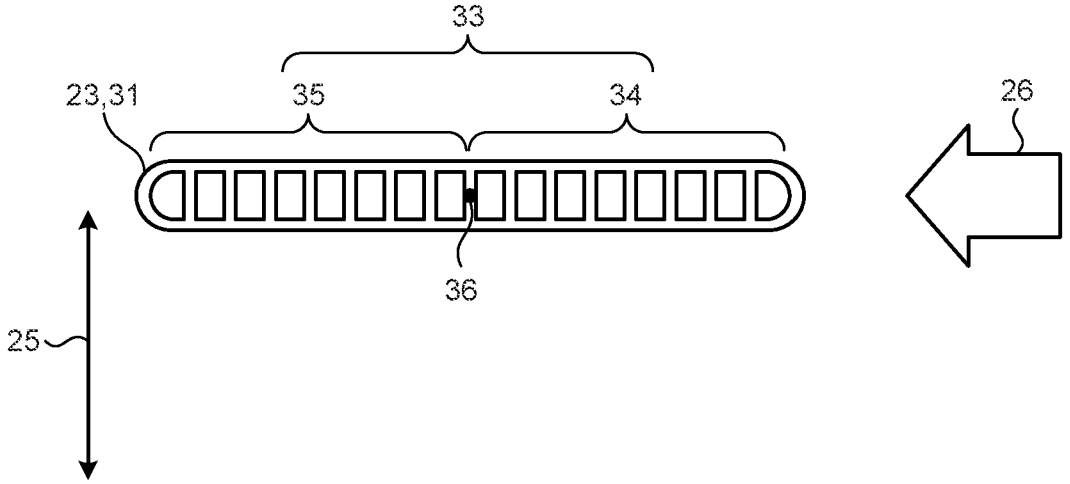
FIG. 4 is a front view illustrating a flat heat transfer tube included in the heat exchanger according to the first embodiment.

A flat heat transfer tube 31 that is one of the plurality of flat heat transfer tubes 23 is formed in a strip shape that is substantially flat, as illustrated in FIG. 4. FIG. 4 is a front view illustrating the flat heat transfer tube 31 included in the heat exchanger according to the first embodiment. The plane along a wider surface of the flat heat transfer tube 31 is parallel to the flow direction 26, and is substantially perpendicular to the up-down direction 25. In the interior portion of the flat heat transfer tube 31, a plurality of flow channels 33 that are arranged so as to be parallel to the flow direction 26 are formed. The plurality of flow channels 33 include a plurality of upwind side flow channels 34 (a plurality of second flow channels) and a plurality of downwind side flow channels 35 (a plurality of first flow channel). The plurality of upwind side flow channels 34 are located at a position closer to the upwind side than a center 36 of an end surface of the flat heat transfer tube 31 in the flow direction 26. The plurality of downwind side flow channels 35 are located at a position closer to the downwind side than the center 36 and are disposed at a position closer to the downwind side than the plurality of upwind side flow channels 34. The other flat heat transfer tubes that are different from the flat heat transfer tube 31 from among the plurality of flat heat transfer tubes 23 are also formed in a similar manner as the flat heat transfer tube 31, and are disposed such that a direction in which the plurality of flow channels 33 that are arranged is parallel to the flow direction 26.

Header 21

Figure 5:
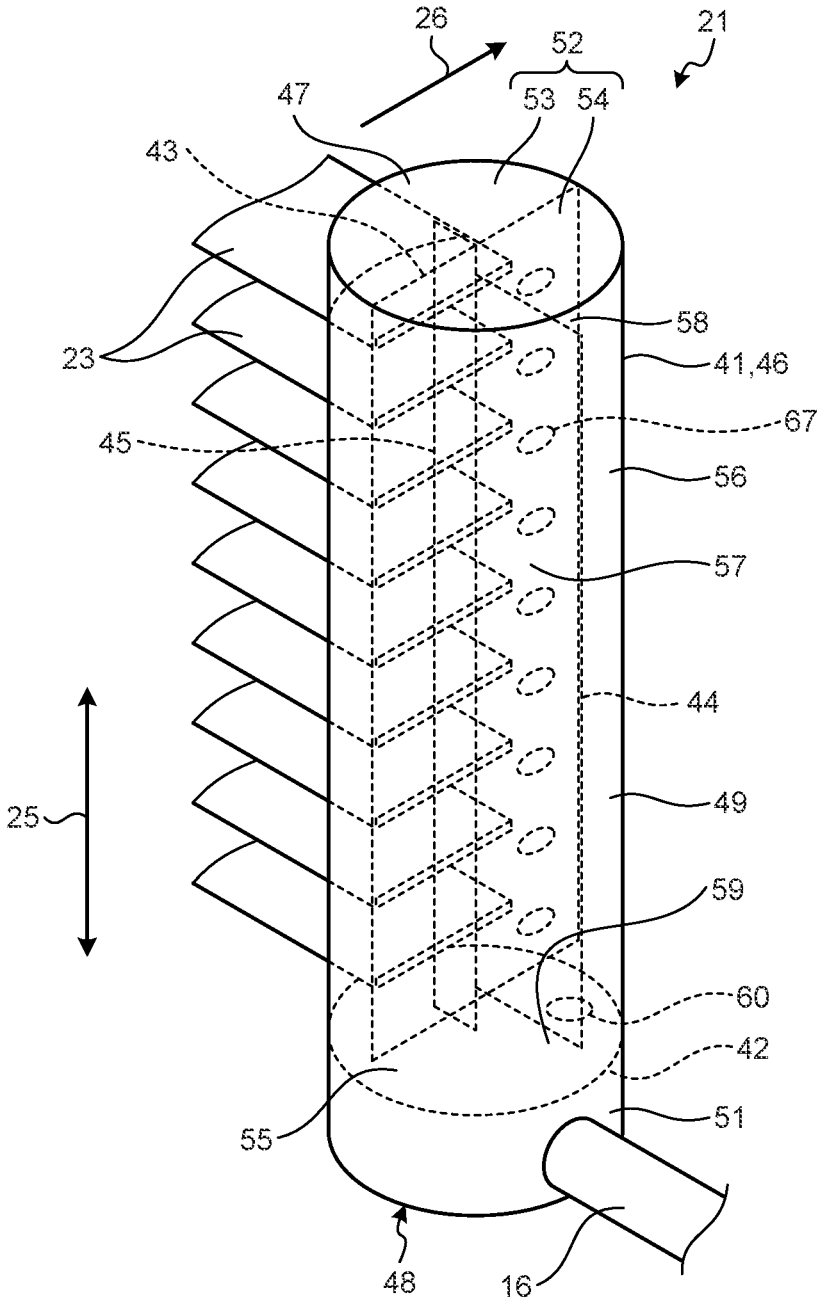
FIG. 5 is a perspective view illustrating a header included in the heat exchanger according to the first embodiment.

FIG. 5 is a perspective view illustrating the header 21 included in the heat exchanger 7 according to the first embodiment. The header 21 includes a main body portion 41, a first partition member 42, a second partition member 43, a third partition member 44, and a wall 45. The main body portion 41 includes a cylindrical member 46, an upper wall member 47, and a lower wall member 48. The cylindrical member 46 is formed in a cylindrical shape, and is disposed so as to be along the straight line that is parallel to the up-down direction 25. The upper wall member 47 blocks an opening located at an upper end of the cylindrical member 46. The lower wall member 48 blocks an opening located at a lower end of the cylindrical member 46. That is, the main body portion 41 is formed in a hollow shape, and, an interior portion space 49 having a columnar shape is formed in the interior portion of the main body portion 41.

The first partition member 42 is formed in a circular plate shape, is disposed in the interior portion space 49 so as to be along the plane that is perpendicular to the up-down direction 25, and is fixed to the main body portion 41 by being bonded to the cylindrical member 46. The interior portion space 49 is divided into a refrigerant inflow space 51 and an upper part space 52 as a result of the first partition member 42 being disposed in the interior portion space 49. The refrigerant inflow space 51 is sandwiched between the first partition member 42 and the lower wall member 48. The upper part space 52 is disposed on the upper side of the refrigerant inflow space 51, and is sandwiched between the first partition member 42 and the upper wall member 47. One end of the refrigerant pipe 16 is bonded to the cylindrical member 46 and fixed to the main body portion 41 such that the flow channel that is formed in the interior portion of the refrigerant pipe 16 is connected to the refrigerant inflow space 51.

The second partition member 43 is formed in a substantially rectangular plate shape. The second partition member 43 is disposed in the upper part space 52, and is fixed to the main body portion 41 by being bonded to the cylindrical member 46 and the upper wall member 47. The plane that is along the second partition member 43 is parallel to the up-down direction 25, and is perpendicular to each of the plurality of straight lines that are along the plurality of respective flat heat transfer tubes 23. The upper part space 52 is divided into an insertion space 53 and a circulation space 54 as a result of the second partition member 43 being disposed in the upper part space 52. The plurality of flat heat transfer tubes 23 pass through a pipe penetration wall portion 68 that is in contact with the insertion space 53 and that is included in the cylindrical member 46 such that the end portions of the plurality of flat heat transfer tubes 23 are disposed in the insertion space 53 (see FIG. 6). The plurality of flow channels 33 formed in the plurality of flat heat transfer tubes 23 are connected to the insertion space 53 as a result of the end portions of the plurality of flat heat transfer tubes 23 being disposed in the insertion space 53. A lower communication path 55 is formed at the lower part of the second partition member 43 as a result of the lower end of the second partition member 43 being away from the first partition member 42. The lower communication path 55 communicates the lower part of the insertion space 53 and the lower part of the circulation space 54.

The third partition member 44 is formed in a substantially rectangular plate shape. The third partition member 44 is disposed in the circulation space 54 so as to be along the plane that is perpendicular to the flow direction 26, and is fixed to the main body portion 41 by being bonded to both of the cylindrical member 46 and the second partition member 43. The circulation space 54 is divided into a first circulation path 56 and a second circulation path 57 as a result of the third partition member 44 being disposed in the circulation space 54. The first circulation path 56 is disposed at a position closer to the downstream side of the flow direction 26 than the second circulation path 57. An upper side communication path 58 is formed in the vicinity of the upper part of the third partition member 44, as a result of an upper end of the third partition member 44 being away from the upper wall member 47. The upper side communication path 58 communicates the upper part of the first circulation path 56 and the upper part of the second circulation path 57. A lower communication path 59 is formed in the vicinity of the lower part of the third partition member 44, as a result of the lower end of the third partition member 44 being away from the first partition member 42. The lower communication path 59 communicates the lower part of the second circulation path 57 and the lower part of the first circulation path 56.

A refrigerant inlet port 60 is formed in the first partition member 42. The refrigerant inlet port 60 is formed at a portion that is in contact with the first circulation path 56 formed in the circulation space 54 in the first partition member 42 and communicates the refrigerant inflow space 51 and the first circulation path 56.

Figure 6:
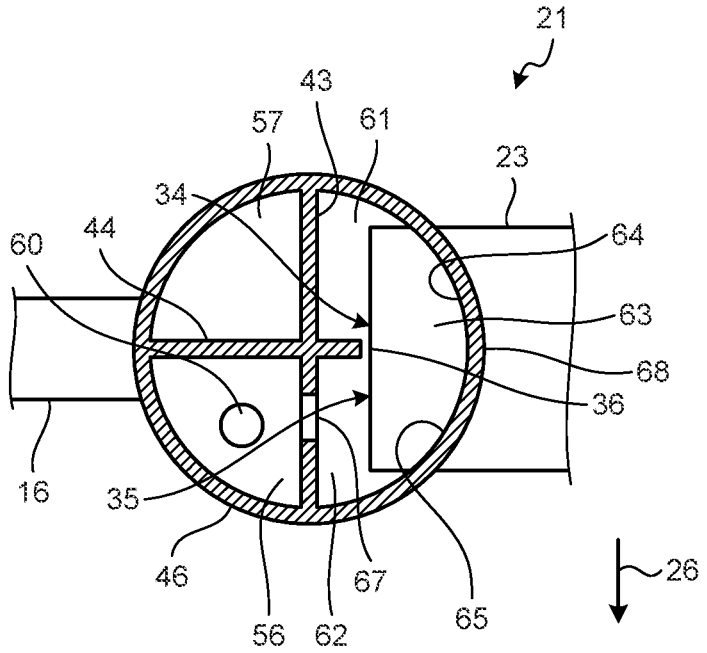
FIG. 6 is a cross-sectional view illustrating the header included in the heat exchanger according to the first embodiment.

The wall 45 is formed in a strip shape. The wall 45 is disposed in the insertion space 53 so as to be along the plane that is perpendicular to the flow direction 26, and is fixed to the main body portion 41 by being bonded to the second partition member 43. FIG. 6 is a cross-sectional view illustrating the header 21 included in the heat exchanger 7 according to the first embodiment. The insertion space 53 is divided into an upwind side insertion space 61 (the second space) and a downwind side insertion space 62 (the first space) as a result of the wall 45 being disposed in the insertion space 53. The wall 45 is disposed such that the plurality of upwind side flow channels 34 formed in the plurality of flat heat transfer tubes 23 are connected to the upwind side insertion space 61, and is also disposed such that the plurality of downwind side flow channels 35 is connected to the downwind side insertion space 62. That is, the wall 45 is formed so as to protrude from the second partition member 43 toward the end portion of the center 36 of the plurality of flat heat transfer tubes 23. A communication path 63 is formed between the wall 45 and the inner wall of the pipe penetration wall portion 68 as a result of the edge on the side opposite to the edge that is bonded to the second partition member 43 from which the wall 45 protrudes being away from the cylindrical member 46 and the end portions of the plurality of flat heat transfer tubes 23. A communication path 63 communicates the upwind side insertion space 61 and the downwind side insertion space 62. Furthermore, the edge on the side opposite to the edge that is bonded to the second partition member 43 from which the wall 45 protrudes is away from the end of the plurality of flat heat transfer tubes 23 in order to prevent the wall 45 from interfering with the plurality of flat heat transfer tubes 23.

An upwind side inner wall surface 64 and a downwind side inner wall surface 65 (inner wall surface) are formed at the pipe penetration wall portion 68 formed in the cylindrical member 46. The upwind side inner wall surface 64 faces the upwind side insertion space 61. The downwind side inner wall surface 65 faces the downwind side insertion space 62. The pipe penetration wall portion 68 is gently bent such that a step is not formed at a boundary between the upwind side inner wall surface 64 and the downwind side inner wall surface 65, that is, the upwind side inner wall surface 64 and the downwind side inner wall surface 65 are smoothly connected. A plurality of refrigerant inlet ports 67 (inlet portion) are formed in the second partition member 43. The plurality of refrigerant inlet ports 67 communicates the first circulation path 56 and the downwind side insertion space 62.

Heating Operation

The air conditioning apparatus 1 performs a heating operation as a result of the four-way valve 6 is switched to the heating mode. The compressor 5 compresses a low pressure gas phase refrigerant that has been supplied from the four-way valve 6, and then, supplies a high pressure gas phase refrigerant that has been generated as a result of the low pressure gas phase refrigerant being compressed to the four-way valve 6 (see FIG. 1). The four-way valve 6 supplies the high pressure gas phase refrigerant supplied from the compressor 5 to the heat exchanger 18 included in the indoor unit 3 as a result of the operation mode being switched to the heating mode. The heat exchanger 18 functions as a condenser, heats the air in a room as a result of heat exchange being subjected to the high pressure gas phase refrigerant supplied from the four-way valve 6 and the air in the room, and supplies, to the expansion valve 8 included in the outdoor unit 2, the high pressure liquid phase refrigerant that is in a supercooled state and that has been generated as a result of the high pressure gas phase refrigerant being radiated. The expansion valve 8 expands the high pressure liquid phase refrigerant supplied from the heat exchanger 18, and supplies, to the heat exchanger 7, the low pressure gas-liquid two-phase refrigerant that is in a state in which the degree of humidity is high and that is generated as a result of the high pressure liquid phase refrigerant being expanded.

The heat exchanger 7 supplies, to the refrigerant inflow space 51, the gas-liquid two-phase refrigerant that has been supplied from the expansion valve 8 (see FIGS. 5 and 6). The gas-liquid two-phase refrigerant supplied to the refrigerant inflow space 51 is supplied to the lower part of the first circulation path 56 via the refrigerant inlet port 60 formed in the first partition member 42. The gas-liquid two-phase refrigerant supplied to the lower part of the first circulation path 56 ascends the first circulation path 56. The gas-liquid two-phase refrigerant ascended the first circulation path 56 is supplied to the upper part of the second circulation path 57 via the upper side communication path 58. The gas-liquid two-phase refrigerant supplied to the upper part of the second circulation path 57 descends the second circulation path 57. The gas-liquid two-phase refrigerant descended the second circulation path 57 is supplied to the lower part of the first circulation path 56 via the lower communication path 59. The gas-liquid two-phase refrigerant supplied to the lower part of the first circulation path 56 via the lower communication path 59 is pushed up by the gas-liquid two-phase refrigerant that is supplied to the first circulation path 56 via the refrigerant inlet port 60, and ascends the first circulation path 56 together with the gas-liquid two-phase refrigerant that is supplied to the first circulation path 56 via the refrigerant inlet port 60.

The gas-liquid two-phase refrigerant that is present in the first circulation path 56 is supplied to the downwind side insertion space 62 formed in the insertion space 53 via each of the plurality of refrigerant inlet ports 67 formed in the second partition member 43. The gas-liquid two-phase refrigerant supplied to the downwind side insertion space 62 becomes a jet stream as a result of passing through the plurality of refrigerant inlet ports 67, flows toward the downwind side inner wall surface 65 of the cylindrical member 46, comes into collision with the downwind side inner wall surface 65. A large amount of liquid refrigerant out of the gas-liquid two-phase refrigerant that has come into collision with the downwind side inner wall surface 65 adheres to the downwind side inner wall surface 65, and the large amount of the gas refrigerant flows into the plurality of downwind side flow channels 35. That is, the gas-liquid two-phase refrigerant is separated into a liquid refrigerant and a gas refrigerant. As a result of the liquid refrigerant adhered to the downwind side inner wall surface 65 being pushed by the gas-liquid two-phase refrigerant that flows from the plurality of refrigerant inlet ports 67 toward the upwind side inner wall surface 64, the liquid refrigerant moves along the pipe penetration wall portion 68 of the cylindrical member 46, and is supplied to the upwind side insertion space 61 via the communication path 63. The flow of the gas refrigerant into the upwind side insertion space 61 is blocked by the wall 45. As a result, a proportion of the liquid refrigerant in the gas-liquid two-phase refrigerant that is present in the upwind side insertion space 61 is larger than a proportion of the liquid refrigerant in the gas-liquid two-phase refrigerant that is present in the downwind side insertion space 62.

Furthermore, the gas-liquid two-phase refrigerant exhibits a substantially similar behavior as a case in which the up-down direction 25 is parallel to the vertical direction even when the up-down direction 25 at the time of installation is slightly inclined with respect to the vertical direction, and a proportion of the liquid refrigerant that is present in the upwind side insertion space 61 is larger than a proportion of the liquid refrigerant that is present in the downwind side insertion space 62.

A part of the liquid refrigerant that is present in the insertion space 53 descends the insertion space 53 caused by gravity, and is retained in the lower part of the insertion space 53. The liquid refrigerant retained in the lower part of the insertion space 53 is supplied to the lower part of the second circulation path 57 via the lower communication path 55. The liquid refrigerant supplied to the lower part of the second circulation path 57 is supplied to the lower part of the first circulation path 56 via the lower communication path 59. The liquid refrigerant supplied to the lower part of the first circulation path 56 is pushed up by the gas-liquid two-phase refrigerant that is supplied to the first circulation path 56 via the refrigerant inlet port 60 and ascends the first circulation path 56 together with the gas-liquid two-phase refrigerant that ascends the first circulation path 56. That is, the gas-liquid two-phase refrigerant supplied to the circulation space 54 at the time of the heating operation ascends the first circulation path 56, and circulates through the circulation space 54 as a result of the gas-liquid two-phase refrigerant descending the second circulation path 57.

The gas-liquid two-phase refrigerant that is present in the upwind side insertion space 61 flows into the plurality of upwind side flow channels 34 formed in the plurality of flat heat transfer tubes 23, respectively, and flows through the plurality of upwind side flow channels 34. The gas-liquid two-phase refrigerant that is present in the downwind side insertion space 62 flows into the plurality of downwind side flow channels 35 formed in the plurality of flat heat transfer tubes 23 and flows through the plurality of downwind side flow channels 35. The gas-liquid two-phase refrigerant flowing through the plurality of upwind side flow channels 34 and the plurality of downwind side flow channels 35 absorbs heat as a result of performing heat exchange with the air flowing outside the plurality of flat heat transfer tubes 23, and changes its state to the low pressure gas phase refrigerant that is in an overheated state. That is, the heat exchanger 7 functions as an evaporator, performs heat exchange between the gas-liquid two-phase refrigerant supplied from the expansion valve 8 and the outside air, and supplies, to the four-way valve 6, the low pressure gas phase refrigerant that is in the overheated state and that has been generated as a result of the gas-liquid two-phase refrigerant absorbing heat. The four-way valve 6 supplies the low pressure gas phase refrigerant supplied from the heat exchanger 7 to the compressor 5.

The mass flow rate of the gas-liquid two-phase refrigerant flowing through the plurality of upwind side flow channels 34 formed in the plurality of flat heat transfer tubes 23 is higher than the mass flow rate of the gas-liquid two-phase refrigerant flowing through the plurality of downwind side flow channels 35 because a proportion of the liquid refrigerant that is present in the upwind side insertion space 61 is higher than a proportion of the liquid refrigerant that is present in the downwind side insertion space 62. The air that is subjected to heat exchange with the refrigerant flowing through the plurality of downwind side flow channels 35 is the air that has been subjected to heat exchange with the refrigerant that flows through the plurality of upwind side flow channels 34. As a result, a temperature difference between the refrigerant flowing through the plurality of upwind side flow channels 34 and the air is larger than a temperature difference between the refrigerant flowing through the plurality of downwind side flow channels 35 and the air. As a result, an amount of heat transferred from the air to the gas-liquid two-phase refrigerant flowing through the plurality of upwind side flow channels 34 is greater than an amount of heat transferred from the air to the gas-liquid two-phase refrigerant flowing through the plurality of downwind side flow channels 35. That is, a relatively large amount heat is transferred to a relatively large amount of gas-liquid two-phase refrigerant flowing through the plurality of upwind side flow channels 34, and a relatively small amount of heat is transferred to a relatively small amount of gas-liquid two-phase refrigerant flowing through the plurality of downwind side flow channels 35. As a result, the heat exchanger 7 is able to make the degree of dryness of the refrigerant that has passed through the plurality of upwind side flow channels 34 and the plurality of downwind side flow channels 35 formed in the plurality of flat heat transfer tubes 23 uniform. As a result, when the heat exchanger 7 is used as an evaporator, it is possible to allow the degree of dryness of the refrigerant that has passed through the heat exchanger 7 and that is present on the outlet side of the heat exchanger 7 to be about 1.0, which is an ideal state.

In a heat exchanger that is used in a comparative example and in which a refrigerant equally flows through the plurality of flow channels 33, after the entire of the liquid refrigerant out of the gas-liquid two-phase refrigerant flowing through the plurality of upwind side flow channels 34 has been evaporated, the gas refrigerant is overheated caused by heat being transferred from air to the evaporated gas refrigerant. In the heat exchanger used in the comparative example, furthermore, the liquid refrigerant out of the gas-liquid two-phase refrigerant flowing through the plurality of downwind side flow channels 35 is not sufficiently subjected to heat exchange with the air and is not completely evaporated. In this case, as compared to a case in which the liquid refrigerant has been completely evaporated, a heat exchange amount between the air and the refrigerant is small. In contrast, the heat exchanger 7 is able to prevent the gas refrigerant from being overheated by making the degree of dryness of the refrigerant that has passed through the plurality of upwind side flow channels 34 and the plurality of downwind side flow channels 35 formed in the plurality of flat heat transfer tubes 23 uniform. As a result, in a case in which the heat exchanger 7 is used as an evaporator, it is possible to allow the degree of dryness of the refrigerant that has passed through the heat exchanger 7 to be about 1.0, which is an ideal state.

Furthermore, in the present embodiment, the refrigerant inlet port 60 is formed at a portion that is communicated with the first circulation path 56 formed in the circulation space 54 in the first partition member 42; however, the refrigerant inlet port 60 may be formed at a portion that is in contact with the second circulation path 57. In this case, the gas-liquid two-phase refrigerant supplied to the refrigerant inflow space 51 is supplied to the lower part of the second circulation path 57 via the refrigerant inlet port 60 formed in the first partition member 42. After that, the gas-liquid two-phase refrigerant ascends the second circulation path 57, and then, descends the first circulation path 56.

Cooling Operation

The air conditioning apparatus 1 performs a cooling operation as a result of the four-way valve 6 being switched to a cooling mode. The compressor 5 compresses the low pressure gas phase refrigerant supplied from the four-way valve 6, and supplies, to the four-way valve 6, the high pressure gas phase refrigerant that has been generated as a result of the low pressure gas phase refrigerant being compressed (see FIG. 1). The four-way valve 6 supplies, to the heat exchanger 7, the high pressure gas phase refrigerant that has been supplied from the compressor 5 as a result of the operation mode being changed to the cooling mode. The high pressure gas phase refrigerant supplied from the four-way valve 6 to the heat exchanger 7 is supplied to the interior portion space of the header 22, and is branched off and flows into the plurality of flow channels 33 formed in the plurality of flat heat transfer tubes 23. The gas refrigerant flowing through the plurality of flow channels 33 changes its state to a high pressure liquid phase refrigerant that is in a supercooled state as a result of performing heat exchange with the air flowing outside the plurality of flat heat transfer tubes 23. The high pressure liquid phase refrigerant flowing through the plurality of flow channels 33 is supplied to the insertion space 53 formed in the header 21 (see FIGS. 5 and 6). The high pressure liquid phase refrigerant supplied to the insertion space 53 (the upwind side insertion space 61 and the downwind side insertion space 62) is supplied to the first circulation path 56 via the plurality of refrigerant inlet ports 67, descends the first circulation path 56, and is retained in the lower part of the first circulation path 56. The high pressure liquid phase refrigerant retained in the lower part of the first circulation path 56 is supplied to the refrigerant inflow space 51 via the refrigerant inlet port 60. The liquid refrigerant supplied to the refrigerant inflow space 51 is supplied to the expansion valve 8 via the refrigerant pipe 16. That is, the heat exchanger 7 performs heat exchange between the high pressure gas phase refrigerant supplied from the four-way valve 6 and the outside air, so that the heat exchanger 7 supplies, to the expansion valve 8, the high pressure liquid phase refrigerant that is in a supercooled state and that has been generated as a result of the high pressure gas phase refrigerant being radiated, and is able to appropriately functions as a condenser.

The expansion valve 8 expands the high pressure liquid phase refrigerant supplied from the heat exchanger 7, and supplies, to the heat exchanger 18, the low pressure gas-liquid two-phase refrigerant that is in a state in which the degree of humidity is high and that is generated as a result of the high pressure liquid phase refrigerant being expanded. The heat exchanger 18 functions as an evaporator, cools the air in the room by performing heat exchange between the low pressure gas-liquid two-phase refrigerant supplied from the expansion valve 8 and the air in the room, and supplies, to the four-way valve 6 included in the outdoor unit 2, the low pressure gas phase refrigerant that is in an overheated state and that is generated as a result of the low pressure gas-liquid two-phase refrigerant absorbing heat. The four-way valve 6 supplies, to the compressor 5 the low pressure gas phase refrigerant supplied from the heat exchanger 18.

In the heat exchanger 7, the plurality of flat heat transfer tubes 23 are away from the wall 45. As a result, the plurality of flat heat transfer tubes 23 do not interfere with the wall 45, so that it is possible to prevent some of the flow channels 33 formed in each of the plurality of flat heat transfer tubes 23 from being crushed, and it is possible to appropriately and reliably allow the refrigerant to flow through the plurality of flat heat transfer tubes 23.

Effects of Heat Exchanger 7 According to First Embodiment

The heat exchanger 7 according to the first embodiment includes the plurality of flat heat transfer tubes 23 and the header 21. The plurality of downwind side flow channels 35 and the plurality of upwind side flow channels 34 are formed in each of the interior portions of the plurality of flat heat transfer tubes 23. The insertion space 53 is formed in an interior portion of the header 21. The header 21 further includes the pipe penetration wall portion 68, the wall 45, and the plurality of refrigerant inlet ports 67. The plurality of flat heat transfer tubes 23 pass through the pipe penetration wall portion 68 such that the plurality of downwind side flow channels 35 are connected to the downwind side insertion space 62 formed in the insertion space 53, and, also, such that the plurality of upwind side flow channels 34 are connected to the upwind side insertion space 61 formed in the insertion space 53. The wall 45 divides the insertion space 53 into the downwind side insertion space 62 and the upwind side insertion space 61. The plurality of refrigerant inlet ports 67 supplies the refrigerant to the downwind side insertion space 62 such that the refrigerant flows toward the downwind side inner wall surface 65 that is in contact with the downwind side insertion space 62 and that is included in the pipe penetration wall portion 68. At this time, the wall 45 is away from the pipe penetration wall portion 68 such that the communication path 63 through which the refrigerant flows from the downwind side insertion space 62 toward the upwind side insertion space 61 is formed between the wall 45 and the pipe penetration wall portion 68.

The heat exchanger 7 according to the first embodiment is able to allow the gas-liquid two-phase refrigerant that is supplied from the plurality of refrigerant inlet ports 67 to the downwind side insertion space 62 to come into collision with the downwind side inner wall surface 65, and is thus able to allow the gas-liquid two-phase refrigerant to be divided into the liquid refrigerant and the gas refrigerant. The wall 45 is able to prevent the gas refrigerant from flowing from the downwind side insertion space 62 to the upwind side insertion space 61, and is able to prevent the liquid refrigerant from flowing from the upwind side insertion space 61 to the downwind side insertion space 62. The heat exchanger 7 is able to allow a proportion of the liquid refrigerant in the gas-liquid two-phase refrigerant that is present in the downwind side insertion space 62 to be larger than a proportion of the liquid refrigerant in the gas-liquid two-phase refrigerant that is present in the upwind side insertion space 61. The heat exchanger 7 is able to allow the flow rate of the refrigerant flowing through the plurality of upwind side flow channels 34 formed in the plurality of flat heat transfer tubes 23 to be larger than the flow rate of the refrigerant flowing through the plurality of downwind side flow channels 35. The heat exchanger 7 is able to improve the heat exchange amount between the air and the refrigerant in the case where the heat exchanger 7 is used as an evaporator and the plurality of upwind side flow channels 34 is disposed on the upwind side.

Furthermore, the plurality of refrigerant inlet ports 67 included in the heat exchanger 7 according to the first embodiment is formed in an area which the downwind side inner wall surface 65 faces. At this time, the heat exchanger 7 according to the first embodiment is able to appropriately allow the gas-liquid two-phase refrigerant supplied from the plurality of refrigerant inlet ports 67 to the downwind side insertion space 62 to come into collision with the pipe penetration wall portion 68, and is able to appropriately separate the gas-liquid two-phase refrigerant into the liquid refrigerant and the gas refrigerant. As a result, the heat exchanger 7 is able to allow the flow rate of the gas-liquid two-phase refrigerant flowing through the plurality of upwind side flow channels 34 formed in the plurality of flat heat transfer tubes 23 to be larger than the flow rate of the gas-liquid two-phase refrigerant flowing through the plurality of downwind side flow channels 35, and is able to improve the heat exchange amount between the air and the refrigerant.

Second Embodiment

Figure 7:
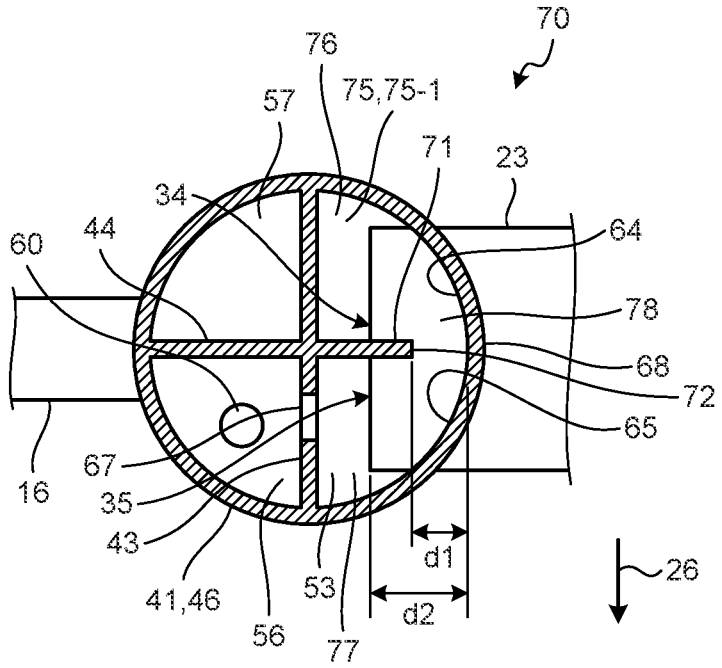
FIG. 7 is a cross-sectional view illustrating a header included in a heat exchanger according to a second embodiment.

A heat exchanger according to a second embodiment has a configuration in which, as illustrated in FIG. 7, the header 21 included in the heat exchanger 7 according to the first embodiment described above is replaced with another header 70. FIG. 7 is a cross-sectional view illustrating the header 70 included in the heat exchanger according to the second embodiment. In the header 70, the wall 45 of the header 21 described above is replaced with another wall 71. The wall 71 is formed in a substantially strip shape, is disposed in the insertion space 53 so as to be along the plane that is perpendicular to the flow direction 26, and is fixed to the main body portion 41 by being bonded to the second partition member 43.

Figure 8:
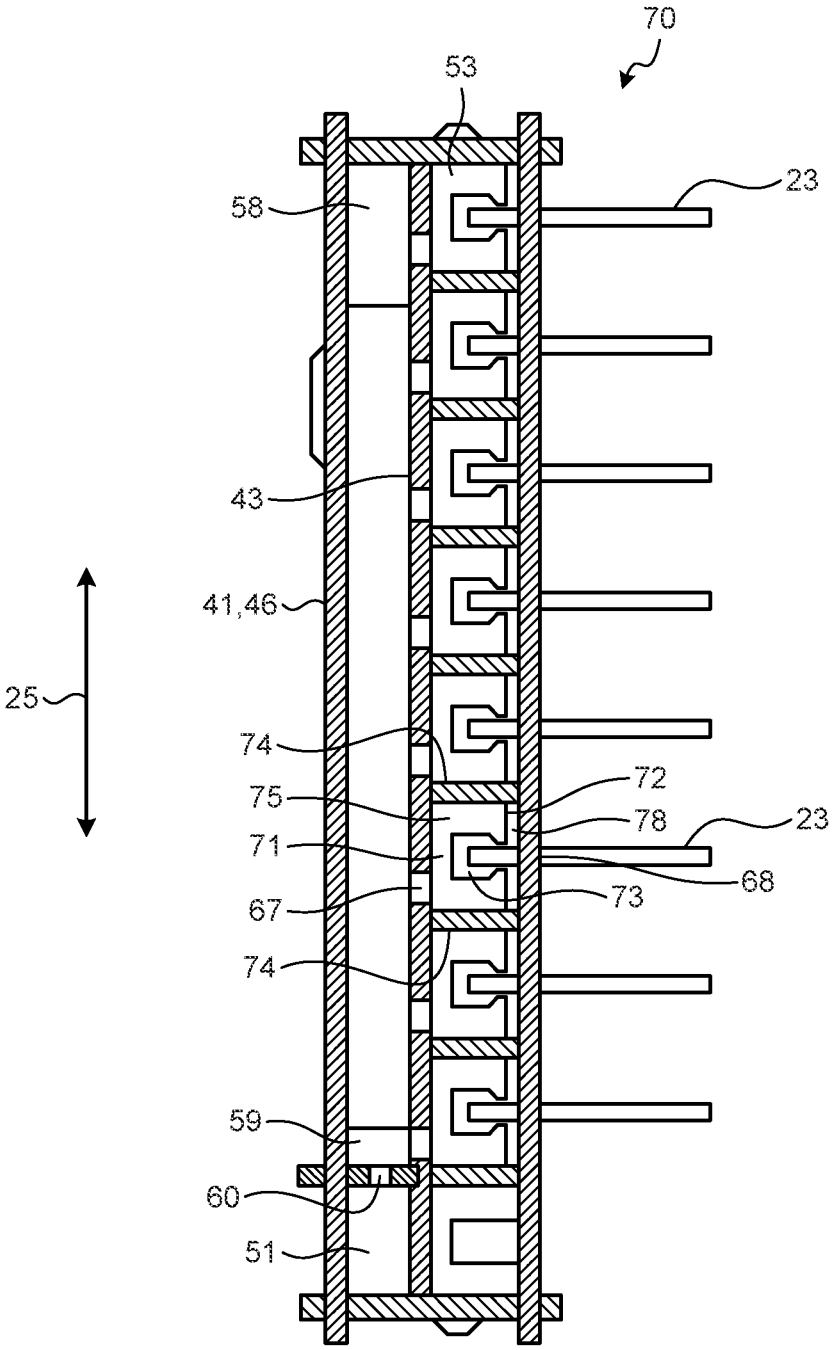
FIG. 8 is a cross-sectional view illustrating the header included in the heat exchanger according to the second embodiment.

FIG. 8 is a cross-sectional view illustrating the header 70 included in the heat exchanger according to the second embodiment. A plurality of notches 73 are formed at an edge 72 that is on the opposite side of the edge that is bonded to the second partition member 43 formed on the wall 71. The wall 71 is provided with the plurality of notches 73 that are used to insert the end portion of the plurality of flat heat transfer tubes 23. Regarding the plurality of flat heat transfer tubes 23, the end portion of each of the plurality of flat heat transfer tubes 23 is inserted to the respective plurality of notches 73, but is away from the wall 71 such that the end surface of each of the plurality of flat heat transfer tubes 23 does not interfere with the wall 71. The wall 71 does not interfere with the end surface of each of the plurality of flat heat transfer tubes 23, the flow channels 33 formed in the plurality of flat heat transfer tubes 23 are not blocked by the wall 71. As illustrated in FIG. 7, a distance d1 between the edge 72 of the wall 71 and the pipe penetration wall portion 68 is smaller than a distance d2 between the end portion of the plurality of flat heat transfer tubes 23 and the pipe penetration wall portion 68.

The heat exchanger according to the second embodiment includes, as illustrated in FIG. 8, a plurality of fourth partition members 74 (a plurality of partition members). Each of the plurality of fourth partition members 74 is formed in a plate shape. The plurality of fourth partition members 74 are disposed in the insertion space 53 so as to be along a plurality of planes each of which is perpendicular to the up-down direction 25, and is fixed to both of the second partition member 43 and the cylindrical member 46. The insertion space 53 is divided into a plurality of insertion spaces 75 as a result of the plurality of fourth partition members 74 being disposed in the insertion space 53. Each of the end portions of the plurality of flat heat transfer tubes 23 is disposed in the plurality of insertion spaces 75. At this time, the plurality of refrigerant inlet ports 67 are formed in the second partition member 43 such that the end portions of the plurality of flat heat transfer tubes 23 do not face the plurality of refrigerant inlet ports 67, respectively. The plurality of refrigerant inlet ports 67 are formed such that each of the lower parts of the plurality of insertion spaces 75 communicates with the first circulation path 56.

As a result of the wall 71 being disposed in the insertion space 53, an insertion space 75-1 included in the plurality of insertion spaces 75 is divided into, as illustrated in FIG. 7, an upwind side insertion space 76 (the second space) and a downwind side insertion space 77 (the first space). The wall 71 is disposed such that the plurality of upwind side flow channels 34 formed in the plurality of flat heat transfer tubes 23 are connected to the upwind side insertion space 76, and is also disposed such that the plurality of downwind side flow channels 35 is connected to the downwind side insertion space 77. The edge 72 of the wall 71 is away from the pipe penetration wall portion 68 formed in the cylindrical member 46, so that a communication path 78 that communicates the upwind side insertion space 76 and the downwind side insertion space 77 is formed between the wall 71 and the pipe penetration wall portion 68. Another insertion space that is different from the insertion space 75-1 included in the plurality of insertion spaces 75 is also divided into, similarly to the insertion space 75-1, the upwind side insertion space 76 and the downwind side insertion space 77, and the communication path 78 is formed.

In the case where the heat exchanger according to the second embodiment is used as an evaporator, a gas-liquid two-phase refrigerant is supplied to the refrigerant inflow space 51 via the refrigerant pipe 16. The gas-liquid two-phase refrigerant supplied to the refrigerant inflow space 51 is supplied to the lower part of the first circulation path 56 formed in the circulation space 54 via the refrigerant inlet port 60, ascends the first circulation path 56, similarly to the case of heat exchanger 7 according to the first embodiment, and descends the second circulation path 57, thus circulating the circulation space 54.

The gas-liquid two-phase refrigerant that is present in the first circulation path 56 is supplied to the downwind side insertion space 77 formed in each of the plurality of insertion spaces 75 via the plurality of refrigerant inlet ports 67 formed in the second partition member 43. The gas-liquid two-phase refrigerant supplied to the downwind side insertion space 77 becomes a jet stream as a result of passing through the plurality of refrigerant inlet ports 67, flows toward the downwind side inner wall surface 65 of the cylindrical member 46, and comes into collision with the downwind side inner wall surface 65. A large amount of liquid refrigerant out of the gas-liquid two-phase refrigerant that has come into collision with the upwind side inner wall surface 64 adheres to the downwind side inner wall surface 65, and a large amount of the gas refrigerant flows into the plurality of downwind side flow channels 35. That is, the gas-liquid two-phase refrigerant is separated into a liquid refrigerant and a gas refrigerant. As a result of the liquid refrigerant adhered to the downwind side inner wall surface 65 being pushed by the gas-liquid two-phase refrigerant that is supplied from the plurality of refrigerant inlet ports 67 to the downwind side insertion space 77, the liquid refrigerant moves along the pipe penetration wall portion 68 formed in the cylindrical member 46, and is supplied to the upwind side insertion space 76 via the communication path 63. The flow of the gas refrigerant into the upwind side insertion space 76 is blocked by the wall 71. As a result, a proportion of the liquid refrigerant in the gas-liquid two-phase refrigerant that is present in the upwind side insertion space 76 is larger than a proportion of the liquid refrigerant in the gas-liquid two-phase refrigerant that is present in the downwind side insertion space 77.

The gas-liquid two-phase refrigerant that is present in the upwind side insertion space 76 flows into the plurality of upwind side flow channels 34 formed in the plurality of flat heat transfer tubes 23, respectively, and flows through the plurality of upwind side flow channels 34. The gas-liquid two-phase refrigerant that is present in the downwind side insertion space 77 flows into the plurality of downwind side flow channels 35 formed in the plurality of flat heat transfer tubes 23, respectively, and flows through the plurality of downwind side flow channels 35. The gas-liquid two-phase refrigerant flowing through the plurality of upwind side flow channels 34 and the plurality of downwind side flow channels 35 absorbs heat as a result of performing heat exchange with the air flowing outside the plurality of flat heat transfer tubes 23, changes its state to the low pressure gas phase refrigerant that is in an overheated state, is supplied to the header 22, and is supplied to the refrigerant pipe 14 via the header 22.

The distance (d1) between the wall 71 and the cylindrical member 46 formed in the heat exchanger according to the second embodiment is smaller than the distance between the wall 45 and the cylindrical member 46 formed in the heat exchanger 7 according to the first embodiment described above. The liquid refrigerant that has come into collision with the downwind side inner wall surface 65 and that is then separated is distributed along the pipe penetration wall portion 68 in a membranous manner. As the distance d1 between the edge 72 of the wall 71 and the pipe penetration wall portion 68 is made small, the distance between the edge 72 of the wall 71 and the membrane surface of the liquid refrigerant that is not illustrated becomes small. The distance described here indicates a width of the flow channel in the communication path 63 in which the gas refrigerant flows, and as the distance is smaller, an amount of the gas refrigerant that is supplied from the downwind side insertion space 77 to the upwind side insertion space 76 via the communication path 78 is decreased. Accordingly, the heat exchanger according to the second embodiment is able to reduce an amount of the gas refrigerant that is supplied from the downwind side insertion space 77 to the upwind side insertion space 76 via the communication path 78 as compared to the heat exchanger 7 according to the first embodiment. Furthermore, as a result of a reduction in the distance between the edge 72 of the wall 71 and the membrane surface of the liquid refrigerant that is not illustrated, an amount of the liquid refrigerant that flows, in the opposite direction, from the upwind side insertion space 76 to the downwind side insertion space 77 via the communication path 78 is reduced, so that, when compared to the heat exchanger 7 according to the first embodiment described above, the heat exchanger according to the second embodiment is able to reduce the amount of the liquid refrigerant that is supplied from the upwind side insertion space 76 to the downwind side insertion space 77 via the communication path 78. As a result, the heat exchanger according to the second embodiment is able to allow a proportion of the liquid refrigerant included in the gas-liquid two-phase refrigerant that is supplied to the plurality of upwind side flow channels 34 formed in the plurality of flat heat transfer tubes 23 to be larger than a proportion of the liquid refrigerant included in the gas-liquid two-phase refrigerant supplied to the plurality of downwind side flow channels 35.

The plurality of refrigerant inlet ports 67 do not face the end portion of the plurality of flat heat transfer tubes 23, respectively, so that the heat exchanger according to the second embodiment is able to prevent the gas-liquid two-phase refrigerant that is supplied to the downwind side insertion space 77 via the plurality of refrigerant inlet ports 67 from coming into collision with the end portion of the plurality of flat heat transfer tubes 23. As a result of the gas-liquid two-phase refrigerant being prevented from coming into contract with end portion of the plurality of flat heat transfer tubes 23, the heat exchanger according to the second embodiment is able to prevent the liquid refrigerant included in the gas-liquid two-phase refrigerant supplied from the plurality of refrigerant inlet ports 67 to the downwind side insertion space 77 from directly flowing into the plurality of downwind side flow channels 35 formed in the plurality of flat heat transfer tubes 23 without coming into collision with the downwind side inner wall surface 65. That is, the heat exchanger according to the second embodiment is able to further reduce the proportion of the liquid refrigerant included in the gas-liquid two-phase refrigerant supplied to the plurality of downwind side flow channels 35. As a result, the heat exchanger according to the second embodiment is able to further allow a proportion of the liquid refrigerant included in the gas-liquid two-phase refrigerant supplied to the plurality of upwind side flow channels 34 formed in the plurality of flat heat transfer tubes 23 to be larger than a proportion of the liquid refrigerant included in the gas-liquid two-phase refrigerant supplied to the plurality of downwind side flow channels 35. The heat exchanger according to the second embodiment is able to improve the heat exchange amount between the air and the gas-liquid two-phase refrigerant as a result of the proportion of the liquid refrigerant in the gas-liquid two-phase refrigerant supplied to the plurality of upwind side flow channels 34 being larger than the proportion of the liquid refrigerant in the gas-liquid two-phase refrigerant supplied to the plurality of downwind side flow channels 35.

In the case where the heat exchanger according to the second embodiment is used as a condenser, the high pressure gas phase refrigerant is supplied to the interior portion space of the header 22 via the refrigerant pipe 14. The high pressure gas phase refrigerant supplied to the interior portion space formed in the header 22 is substantially equally branched off and flows into the plurality of flow channels 33 formed in the plurality of flat heat transfer tubes 23. The gas refrigerant flowing through the plurality of flow channels 33 changes its state to a high pressure liquid phase refrigerant that is in a supercooled state as a result of performing heat exchange with the air flowing outside the plurality of flat heat transfer tubes 23. The high pressure liquid phase refrigerant flowing through the plurality of flow channels 33 is supplied to the plurality of insertion spaces 75 formed in the header 21. The high pressure liquid phase refrigerant supplied to the plurality of insertion spaces 75 is retained in the lower part of the plurality of insertion spaces 75. The high pressure liquid phase refrigerant retained in the lower part of the plurality of insertion spaces 75 is supplied to the first circulation path 56 via the plurality of refrigerant inlet ports 67, descends the first circulation path 56, and is retained in the lower part of the first circulation path 56. The high pressure liquid phase refrigerant retained in the lower part of the first circulation path 56 is supplied to the refrigerant inflow space 51 via the refrigerant inlet port 60 and supplied to the refrigerant pipe 16.

Similarly to the heat exchanger 7 according to the first embodiment described above, the heat exchanger according to the second embodiment is able to be appropriately used as a condenser. Furthermore, the plurality of refrigerant inlet ports 67 are formed at the lower parts of the plurality of insertion spaces 75, respectively, the heat exchanger according to the second embodiment is further able to appropriately supply the high pressure liquid phase refrigerant that is retained in each of the lower parts of the plurality of insertion spaces 75 to the first circulation path 56. As a result, even if the plurality of insertion spaces are formed, the heat exchanger according to the second embodiment is able to reduce the amount of the high pressure liquid phase refrigerant retained in each of the lower parts of the plurality of insertion spaces 75 and is able to appropriately supply the high pressure liquid phase refrigerant to the expansion valve 8 in the case where the heat exchanger is used as a condenser.

Incidentally, the plurality of refrigerant inlet ports 67 included in the heat exchanger according to the second embodiment is formed such that the plurality of refrigerant inlet ports 67 do not face the end portions of the plurality of flat heat transfer tubes 23, respectively; however, the plurality of refrigerant inlet ports 67 may face the end portions of the plurality of flat heat transfer tubes 23. Even if the plurality of refrigerant inlet ports 67 face the end portions of the plurality of flat heat transfer tubes 23, respectively, the heat exchanger according to the second embodiment is able to further allow the mass flow rate of the refrigerant flowing through the plurality of upwind side flow channels 34 to be larger than the mass flow rate of the refrigerant flowing through the plurality of downwind side flow channels 35 in the case where the heat exchanger according to the second embodiment is used as an evaporator. As a result, the heat exchanger according to the second embodiment is able to improve the heat exchange amount between the air and the gas-liquid two-phase refrigerant.

Third Embodiment

Figure 9:
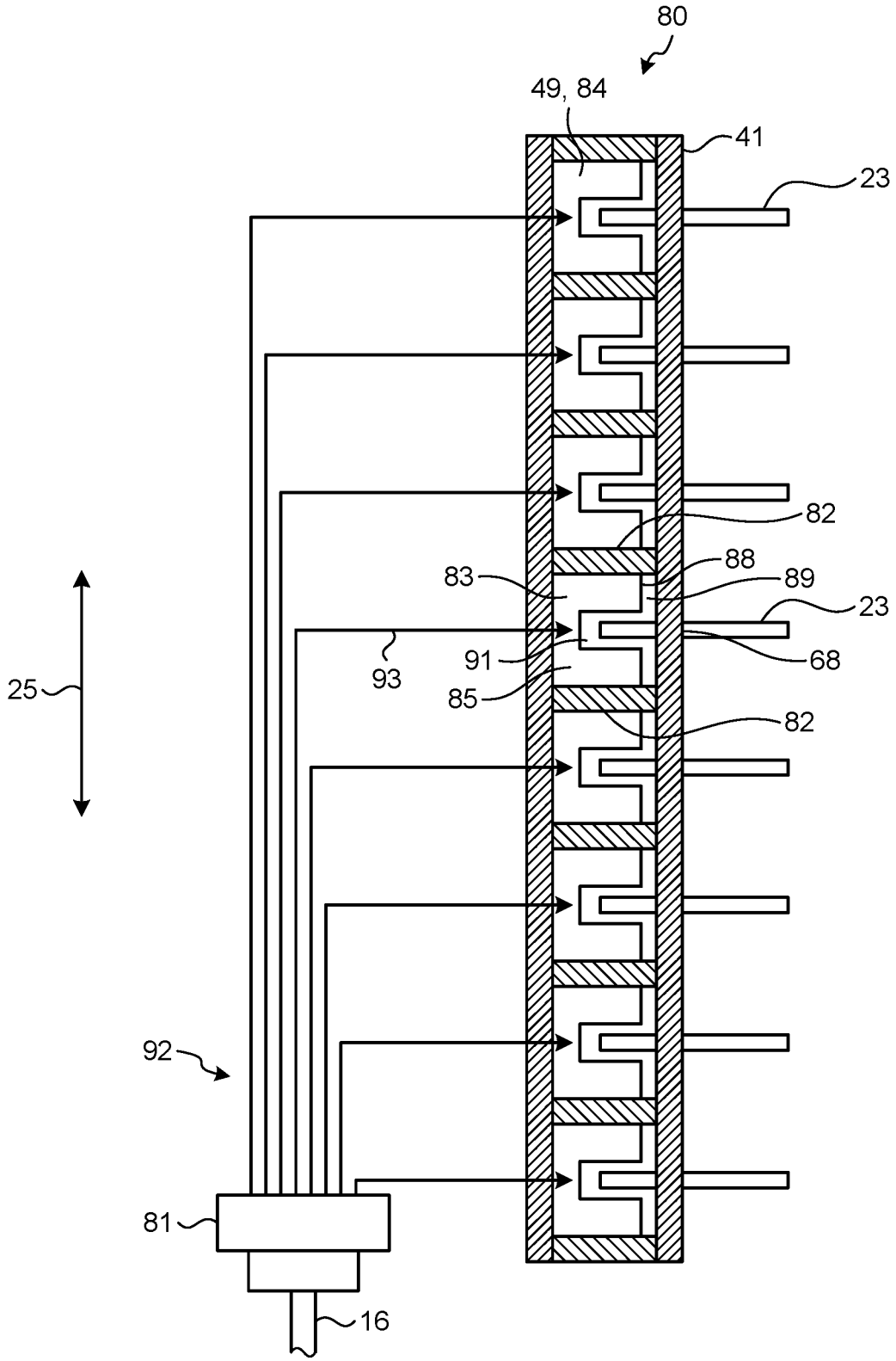
FIG. 9 is a longitudinal sectional view illustrating a header included in a heat exchanger according to a third embodiment.

As illustrated in FIG. 9, a heat exchanger according to a third embodiment has a configuration in which the header 21 included in the heat exchanger 7 according to the first embodiment described above is replaced with another header 80 and a flow divider 81 is further included. FIG. 9 is a longitudinal sectional view illustrating the header 80 included in the heat exchanger according to the third embodiment. Similarly to the header 21 as described above, the header 80 includes the main body portion 41 described above. The header 80 further includes a plurality of partition members 82 and a wall 83. Each of the plurality of partition members 82 is formed in a plate shape, is disposed in the interior portion space 49 formed in the main body portion 41 so as to be along a plurality of planes that is perpendicular to the up-down direction 25, and is fixed to the main body portion 41. The interior portion space 49 divided into a plurality of insertion spaces 84 as a result of the plurality of partition members 82 being disposed in the interior portion space 49. The plurality of partition members 82 are disposed such that the end portions of the plurality of flat heat transfer tubes 23 are disposed in the plurality of insertion spaces 84, respectively.

Figure 10:
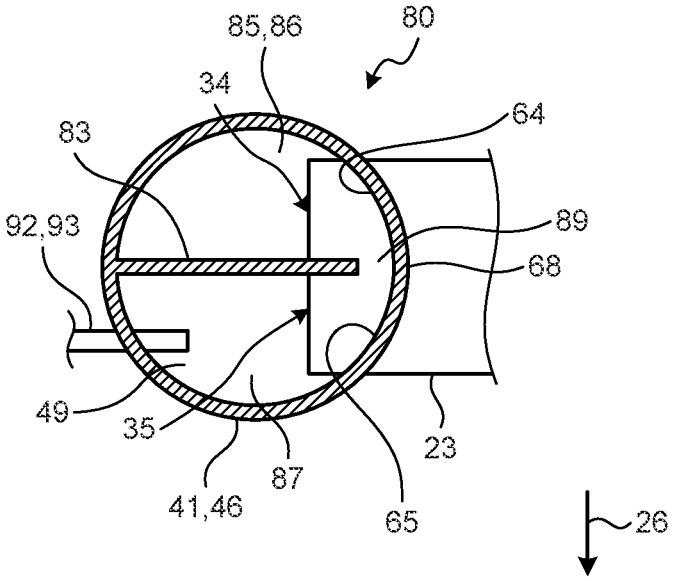
FIG. 10 is a cross-sectional view illustrating the header included in the heat exchanger according to the third embodiment.

The wall 83 is formed in a substantially strip shape. FIG. 10 is a cross-sectional view illustrating the header 80 included in the heat exchanger according to the third embodiment. The wall 83 is disposed in the interior portion space 49 so as to be along a plane that is perpendicular to the flow direction 26. An insertion space 85 that is one of the plurality of insertion spaces 84 is divided into an upwind side insertion space 86 (the second space) and a downwind side insertion space 87 (the first space) as a result of the wall 83 being disposed in the interior portion space 49. The wall 83 is disposed such that the plurality of upwind side flow channels 34 formed in the plurality of flat heat transfer tubes 23 are connected to the upwind side insertion space 86, and is also disposed such that the plurality of downwind side flow channels 35 are connected to the downwind side insertion space 87. An edge 88 of the wall 83 closer to the plurality of flat heat transfer tubes 23 is away from the pipe penetration wall portion 68 formed in the cylindrical member 46, so that a communication path 89 that communicates the upwind side insertion space 86 and the downwind side insertion space 87 is formed between the wall 83 and the pipe penetration wall portion 68.

As illustrated in FIG. 9, a plurality of notches 91 are formed at the edge 88 of the wall 83. The plurality of notches 91 are disposed on the wall 83 in which the end portions of the plurality of flat heat transfer tubes 23 are inserted. The end portions of the plurality of flat heat transfer tubes 23 are inserted into the plurality of notches 91, respectively, so that the plurality of flat heat transfer tubes 23 is away from the wall 83 so as not to interfere with the wall 83. Furthermore, the distance between the edge 88 of the wall 83 and the pipe penetration wall portion 68 is smaller than the distance between the end portion of the plurality of flat heat transfer tubes 23 and the pipe penetration wall portion 68. Similarly to the insertion space 85, another insertion space that is different from the insertion space 85 and that is included in the plurality of insertion spaces 84 is also divided into the upwind side insertion space 86 and the downwind side insertion space 87, and the communication path 89 is formed.

The flow divider 81 is connected to the refrigerant pipe 16 and is connected to one end of a plurality of refrigerant pipes 92. The other end of each of the plurality of refrigerant pipes 92 is connected to the plurality of respective insertion spaces 84. As illustrated in FIG. 10, a refrigerant pipe 93 that is connected to the insertion space 85 and that is included in the plurality of refrigerant pipes 92 passes through the cylindrical member 46 such that the end portion of the refrigerant pipe 93 is disposed in the downwind side insertion space 87 formed in the insertion space 85 and is connected to the downwind side insertion space 87 formed in the insertion space 85. The refrigerant pipe 93 is disposed such that the end portion of the refrigerant pipe 93 is oriented to the downwind side inner wall surface 65, that is, the downwind side inner wall surface 65 faces the end portion of the refrigerant pipe 93. Similarly to the refrigerant pipe 93, regarding the other refrigerant pipes that are different from the refrigerant pipe 93 and that are included in the plurality of refrigerant pipes 92, the end portions of the other refrigerant pipes are also disposed in the downwind side insertion space 87 such that the end portions are oriented to the downwind side inner wall surface 65.

In the case where the heat exchanger according to the third embodiment is used as an evaporator, a gas-liquid two-phase refrigerant is supplied to the flow divider 81 via the refrigerant pipe 16. The flow divider 81 is, for example, a distributor, branches off the gas-liquid two-phase refrigerant supplied via the refrigerant pipe 16 so as to have substantially the same degree of dryness, and supplies, to the downwind side insertion space 87 of each of the plurality of insertion spaces 84, the gas-liquid two-phase refrigerants having substantially the same degree of dryness via the plurality of refrigerant pipes 92, respectively. The gas-liquid two-phase refrigerant supplied to the downwind side insertion space 87 formed in the insertion space 85 becomes a jet stream as a result of passing through the plurality of refrigerant inlet ports 67, flows toward the downwind side inner wall surface 65 of the cylindrical member 46, and comes into collision with the downwind side inner wall surface 65. A large amount of a liquid refrigerant out of the gas-liquid two-phase refrigerant that has come into collision with the upwind side inner wall surface 64 adheres to the downwind side inner wall surface 65, and a large amount of gas refrigerant flows in the plurality of downwind side flow channels 35. That is, the gas-liquid two-phase refrigerant is separated into a liquid refrigerant and a gas refrigerant. As a result of the liquid refrigerant adhered to the downwind side inner wall surface 65 being pushed by the gas-liquid two-phase refrigerant that is supplied from the refrigerant pipe 93 to the downwind side insertion space 87, the liquid refrigerant moves along the pipe penetration wall portion 68 of the cylindrical member 46, and is supplied to the upwind side insertion space 86 via the communication path 89. The flow of the gas refrigerant into the upwind side insertion space 86 is blocked by the wall 83. As a result, a proportion of the liquid refrigerant in the gas-liquid two-phase refrigerant that is present in the upwind side insertion space 86 is larger than a proportion of the liquid refrigerant in the gas-liquid two-phase refrigerant that is present in the downwind side insertion space 87.

The gas-liquid two-phase refrigerant that is present in the upwind side insertion space 86 flows into the plurality of upwind side flow channels 34 formed in the plurality of flat heat transfer tubes 23, respectively, and flows through the plurality of upwind side flow channels 34. The gas-liquid two-phase refrigerant that is present in the downwind side insertion space 87 flows into the plurality of downwind side flow channels 35 formed in the plurality of flat heat transfer tubes 23, respectively, and flows through the plurality of downwind side flow channels 35. The gas-liquid two-phase refrigerant flowing through the plurality of upwind side flow channels 34 and the plurality of downwind side flow channels 35 absorbs heat as a result of performing heat exchange with the air flowing outside the plurality of flat heat transfer tubes 23, changes its state to the low pressure gas phase refrigerant that is in an overheated state, is supplied to the header 22, and is supplied to the refrigerant pipe 14 via the header 22.

similarly to the above described heat exchanger according to the second embodiment, when the heat exchanger according to the third embodiment is used as an evaporator, the heat exchanger according to the third embodiment is able to allow the mass flow rate of the gas-liquid two-phase refrigerant supplied to the plurality of upwind side flow channels 34 formed in the plurality of flat heat transfer tubes 23 to be larger than the mass flow rate of the gas-liquid two-phase refrigerant supplied to the plurality of downwind side flow channels 35. As a result, the heat exchanger according to the third embodiment is able to improve the heat exchange amount between the air and the gas-liquid two-phase refrigerant.

In the case where the heat exchanger according to the third embodiment is used as a condenser, the high pressure gas phase refrigerant is supplied to the interior portion space of the header 22 via the refrigerant pipe 14. The high pressure gas phase refrigerant supplied to the interior portion space of the header 22 is substantially equally branched off and flows into the plurality of flow channels 33 formed in the plurality of flat heat transfer tubes 23. The gas refrigerant flowing into the plurality of flow channels 33 changes its state to the high pressure liquid phase refrigerant that is in a supercooled state as a result of performing heat exchange with the air flowing outside the plurality of flat heat transfer tubes 23. The high pressure liquid phase refrigerant flowing through the plurality of flow channels 33 is supplied to each of the plurality of insertion spaces 84 formed in the header 80. The high pressure liquid phase refrigerant supplied to the plurality of insertion spaces 84 is supplied to the flow divider 81 via the plurality of refrigerant pipes 92, and is supplied to the refrigerant pipe 16. In this way, similarly to the heat exchanger according to the heat exchanger according to the first and the second embodiment as described above, the heat exchanger according to the third embodiment is able to be appropriately used as a condenser.

Incidentally, the plurality of upwind side flow channels 34 and the plurality of downwind side flow channels 35 formed in the flat heat transfer tube 31 are divided at the center 36 of the end surface of the flat heat transfer tube 31, but may be divided at another position that is different from the center 36 of the end surface of the flat heat transfer tube 31. In this case, also, when the heat exchanger is used as an evaporator, the heat exchanger is able to allow the mass flow rate of the plurality of upwind side flow channels 34 to be larger than the mass flow rate of the plurality of downwind side flow channels 35, and is thus able to improve the heat exchange amount between the refrigerant.

As described above, the embodiment has been described; however, the embodiment is not limited by the described content. Furthermore, the components described above includes one that can easily be thought of by those skilled in the art, one that is substantially the same, one that is within the so-called equivalents. In addition, the components described above may also be appropriately used in combination. In addition, at least one of various omissions, replacements, and modifications of components may be made without departing from the scope of the embodiment.

REFERENCE SIGNS LIST

7 heat exchanger
21 header
23 plurality of flat heat transfer tubes
34 plurality of upwind side flow channels
35 plurality of downwind side flow channels
41 main body portion
42 first partition member
43 second partition member
44 third partition member
45 wall
53 insertion space
61 upwind side insertion space
62 downwind side insertion space
63 communication path
64 upwind side inner wall surface
65 downwind side inner wall surface
67 plurality of refrigerant inlet ports
68 pipe penetration wall portion
70 header
71 wall
72 edge
73 plurality of notches
74 plurality of fourth partition members
75 plurality of insertion spaces
76 upwind side insertion space
77 downwind side insertion space
78 communication path
80 header
82 plurality of partition members
83 wall
84 plurality of insertion spaces
86 upwind side insertion space
87 downwind side insertion space
88 edge
89 communication path
91 plurality of notches

The invention claimed is:

1. A heat exchanger comprising:

a plurality of flat heat transfer tubes in each of which a plurality of first flow channels and a plurality of second flow channels are formed in an interior portion of each of the plurality of flat heat transfer tubes; and a header in which an insertion space is formed, wherein the header includes a pipe penetration wall portion through which the plurality of flat heat transfer tubes pass such that the plurality of first flow channels are connected to a first space included in the insertion space and the plurality of second flow channels are connected to a second space included in the insertion space, the pipe penetration wall portion being provided with a first inner wall surface that is in contact with the first space and a second inner wall surface that is in contact with the second space, an inlet portion that supplies a refrigerant to the first space such that:

the refrigerant supplied to the first space contains a first refrigerant flowing toward the first inner wall surface and a second refrigerant flowing toward the second inner wall surface;

an amount of the first refrigerant is greater than an amount of the second refrigerant; and the first refrigerant comes into collision with the first inner wall surface and is separated into a gas refrigerant and a liquid refrigerant, and a wall that divides the insertion space into the first space and the second space to block flow of the gas refrigerant from the first space to the second space, and the wall is away from the pipe penetration wall portion such that a communication path through which the liquid refrigerant flows from the first space to the second space is formed between the wall and the pipe penetration wall portion.

2. The heat exchanger according to claim 1, wherein the inlet portion is formed in an area which the first inner wall surface faces.

3. The heat exchanger according to claim 1, wherein the header further includes a partition member that separates a circulation space in which the refrigerant circulates and the insertion space, and the inlet portion is a hole that is formed in the partition member and that communicates the first space and the circulation space.

4. The heat exchanger according to claim 1, wherein a plurality of notches in which end portions of the plurality of flat heat transfer tubes are inserted, respectively, are formed on the convex wall.

5. The heat exchanger according to claim 1, wherein the header further includes a plurality of partition members that divide the insertion space into a plurality of spaces in which the plurality of flat heat transfer tubes are disposed, respectively, and the inlet portion includes a plurality of inlet portions that supply the refrigerant to the plurality of spaces, respectively.

6. The heat exchanger according to claim 5, wherein the plurality of inlet portions are disposed such that end surfaces of the plurality of flat heat transfer tubes do not face the plurality of inlet portions, respectively.

7. The heat exchanger according to claim 5, wherein the plurality of inlet portions are formed so as to be connected to lower parts of the plurality of spaces, respectively.

8. The heat exchanger according to claim 3, wherein the inlet portion is formed in an area which the first inner wall surface faces.

9. The heat exchanger according to claim 3, wherein a plurality of notches in which end portions of the plurality of flat heat transfer tubes are inserted, respectively, are formed on the convex wall.

10. The heat exchanger according to claim 3, wherein the header further includes a plurality of partition members that divide the insertion space into a plurality of spaces in which the plurality of flat heat transfer tubes are disposed, respectively, and the inlet portion includes a plurality of inlet portions that supply the refrigerant to the plurality of spaces, respectively.

11. The heat exchanger according to claim 10, wherein the plurality of inlet portions are disposed such that end surfaces of the plurality of flat heat transfer tubes do not face the plurality of inlet portions, respectively.

12. The heat exchanger according to claim 10, wherein the plurality of inlet portions are formed so as to be connected to lower parts of the plurality of spaces, respectively.

* * * * *